US009186928B2

(12) United States Patent
Talbot et al.

(10) Patent No.: US 9,186,928 B2
(45) Date of Patent: Nov. 17, 2015

(54) PULL ACTIVATED GREETING CARDS AND GIFT BAGS WITH MOTION AND AUDIO

(71) Applicant: American Greetings Corporation, Cleveland, OH (US)

(72) Inventors: John Talbot, Bay Village, OH (US); Melissa Flesher, Avon, OH (US); Dan Liuzzi, Westlake, OH (US); Sean Higgins, Cleveland, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/487,274

(22) Filed: Sep. 16, 2014

(65) Prior Publication Data

US 2015/0000167 A1 Jan. 1, 2015

Related U.S. Application Data

(63) Continuation-in-part of application No. 13/447,458, filed on Apr. 16, 2012, now abandoned, which is a continuation-in-part of application No. 12/940,145, filed on Nov. 5, 2010, now Pat. No. 8,230,624.

(60) Provisional application No. 61/884,108, filed on Sep. 29, 2013, provisional application No. 61/286,184, filed on Dec. 14, 2009.

(51) Int. Cl.

| | |
|---|---|
| ***B42D 15/00*** | (2006.01) |
| ***B42D 15/02*** | (2006.01) |
| ***B65D 33/00*** | (2006.01) |
| *B42D 15/04* | (2006.01) |

(52) U.S. Cl.

CPC ..... *B42D 15/022* (2013.01); *B42D 15/027* (2013.01); *B65D 33/00* (2013.01); *B42D 15/042* (2013.01)

(58) Field of Classification Search

CPC .. B42D 15/022; B42D 15/042; B42D 15/045; G06F 27/00; G06F 1/00

See application file for complete search history.

(56) References Cited

U.S. PATENT DOCUMENTS

| | | | | |
|---|---|---|---|---|
| 2009/0126239 | A1* | 5/2009 | Clegg | 40/124.03 |
| 2009/0241387 | A1* | 10/2009 | Wong | 40/455 |
| 2013/0097899 | A1 | 4/2013 | Budzar et al. | |
| 2013/0139417 | A1 | 6/2013 | Mayer et al. | |
| 2013/0139418 | A1 | 6/2013 | Bogdanski et al. | |

* cited by examiner

*Primary Examiner* — Casandra Davis
(74) *Attorney, Agent, or Firm* — Christine Flanagan

(57) ABSTRACT

The greeting card of the present invention is a traditional greeting card enhanced by audio and movement. The greeting card contains a pull trigger mechanism so that the user must interact with the greeting card to trigger the audio and motor movement. The pull trigger mechanism may be made of a variety of different materials and are intended to resemble the tail of various animals. Once the pull mechanism or tail has been pulled, the motor is activated causing movement of a portion of the greeting card proximate to the pull mechanism or tail which resembles the behind of an animal. The moveable portion of the greeting card moves, by for example back and forth, while audio plays in the background.

15 Claims, 5 Drawing Sheets

PULL ACTIVATED GREETING CARDS AND GIFT BAGS WITH MOTION AND AUDIO

RELATED APPLICATIONS

This application claims priority to U.S. Provisional Patent Application No. 61/884,108, filed on Sep. 29, 2013.

This application is also a continuation-in-part of U.S. patent application Ser. No. 13/447,458, filed on Apr. 16, 2012 which is a continuation-in-part of U.S. patent application Ser. No. 12/940,145, filed on Nov. 5, 2010 (now U.S. Pat. No. 8,230,624) which claims priority to U.S. Provisional Patent Application No. 61/286,184, filed on Dec. 14, 2009.

FIELD OF THE INVENTION

The current invention is in the field of social expression products and is more specifically directed to interactive greeting cards and gift bags having pull activation of special effects

SUMMARY OF THE INVENTION

The greeting card of the present invention combines a traditional card with clever artwork, a motor module, a sound module, and a pull trigger. The greeting card contains artwork which depicts the hind end of an animal. The actual behind of the animal is represented by a die cut shape which is connected to the motor module. Attached to the die cut shape representing the animals behind, is a piece of material representing the animal's tail and serving as a pull trigger mechanism which when pulled causes movement of the mobile object and playback of re-recorded audio, giving an impression that the animal is dancing to or at least shaking it's behind to the music.

DETAILED DESCRIPTION OF PREFERRED AND ALTERNATE EMBODIMENTS

Figure 1:
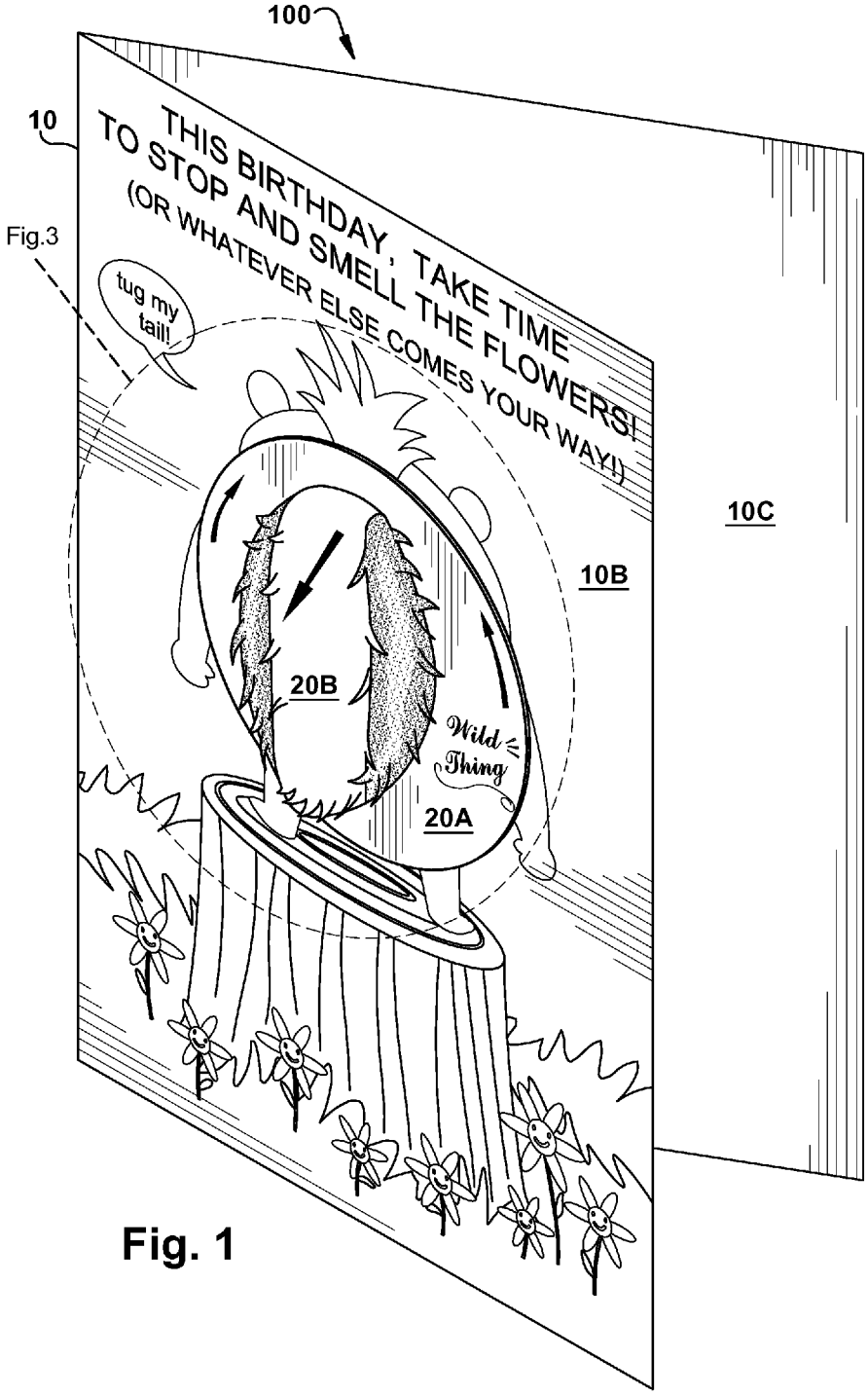
FIG. 1 is a perspective view of one embodiment of the greeting card of the present invention.

The greeting card of the present invention is a traditional greeting card enhanced by audio and movement. The greeting card contains a pull trigger mechanism so that the user must interact with the greeting card to trigger the audio and motor movement. The pull trigger mechanism may be made of a variety of different materials and are intended to resemble the tail of various animals printed on the greeting card. Once the pull mechanism or tail has been pulled, the motor is activated causing movement of a portion of the greeting card which includes the pull mechanism or tail. The moveable portion of the greeting card moves, by for example back and forth, while audio plays in the background.

The greeting card body 10 may have multiple panels connected along multiple fold lines. In a preferred embodiment, the greeting card body 10 contains three panels, a first panel (not shown) connected to a second panel 10B along a first fold line and a third panel 10C connected to the second panel along a second fold line. The first and second 10B panels may be overlapped and attached along all free edges to form a cavity therebetween. The first panel (not shown) serves as the inside left panel of the greeting card 100, the second panel 10B serves as the front cover panel of the greeting card 100 and the third panel 10C serves as the inside right panel of the greeting card 100 and the back cover panel of the greeting card 100. Alternatively, the second and third panel may be overlapped and attached to form the cavity. The greeting card panels each have a front surface and a rear surface opposite the front surface which are both substantially planar. Both the front and back surfaces of each of the greeting card panels may contain printing thereon such as text sentiment, drawings, photographs, artwork and the like. Additional embellishments may be added.

The electronic components of the greeting card 100 are contained and concealed within the cavity formed by the two adjacent greeting card panels. These electronic components may include, but are not limited to: a printed circuit board 22, an integrated circuit, a power source such as one or more disposable batteries 24, a speaker 26, a sound module, a memory storage device, and a motor module. Any other electronic component which is required to or which facilitates motor movement and audio playback may be included within the greeting card. Other components are known to those with skill in the art. The motor module may contain a small motor 12 having a rotating gear mechanism 14 that when activated turns a circular gear 16. A connecting rod is located between and connects the gear and a mobile object. The connecting rod 18 extends from the motor 12 through a small opening in one of the greeting card panels to connect to the mobile object 20. In a preferred embodiment, the mobile object 20 includes a backer panel 20A made of paperboard, cardboard, card stock or the like, which has a pull mechanism 20B attached thereto. The pull mechanism 20B is shaped and designed to, along with the artwork on the greeting card 100, bear a likeness to the hind end of an animal, such as a horse, pig, etc. The pull mechanism 20B is intended to symbolize the animal's tail and is also used to trigger the audio and motor movement of the mobile object 20. The mobile object 20 is connected to a trigger or switch mechanism 28 by a pull string 30 such that when the mobile object 20, or more specifically the pull mechanism or tail 20B is pulled, it pulls the pull string which causes the trigger mechanism 28 to activate the sound and motor modules. As the circular gear 16 is rotated by the rotating gear mechanism 14, it in turn causes the mobile object 20 to move in an up-and-down, back-and-forth, side-to-side, or any other reciprocal motion. In a preferred embodiment, the mobile object 20 is located on the front or outside cover 10B of the greeting card 100.

Figure 2:
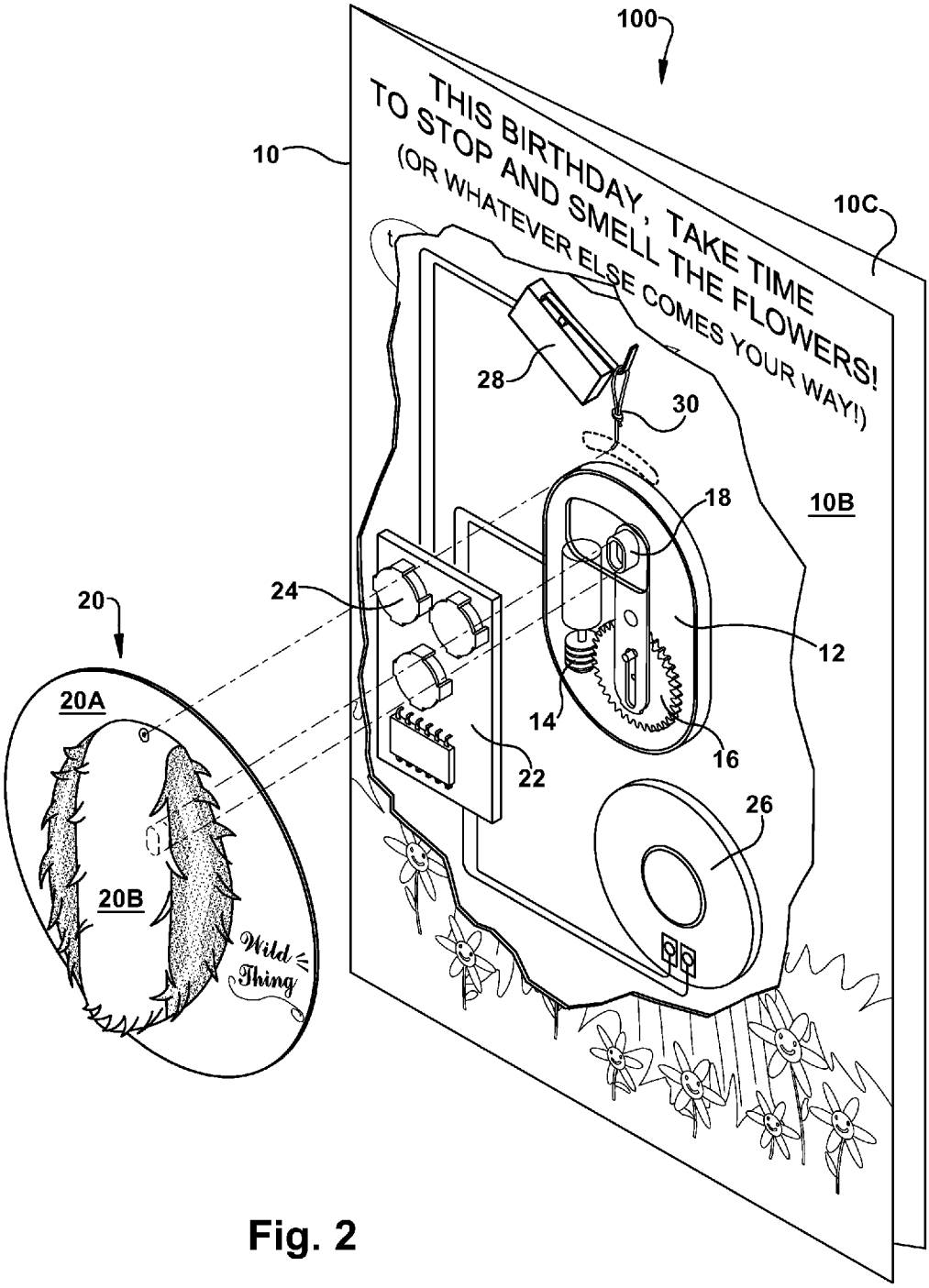
FIG. 2 is a perspective tear-away view of the greeting card of FIG. 1.
Figure 3:
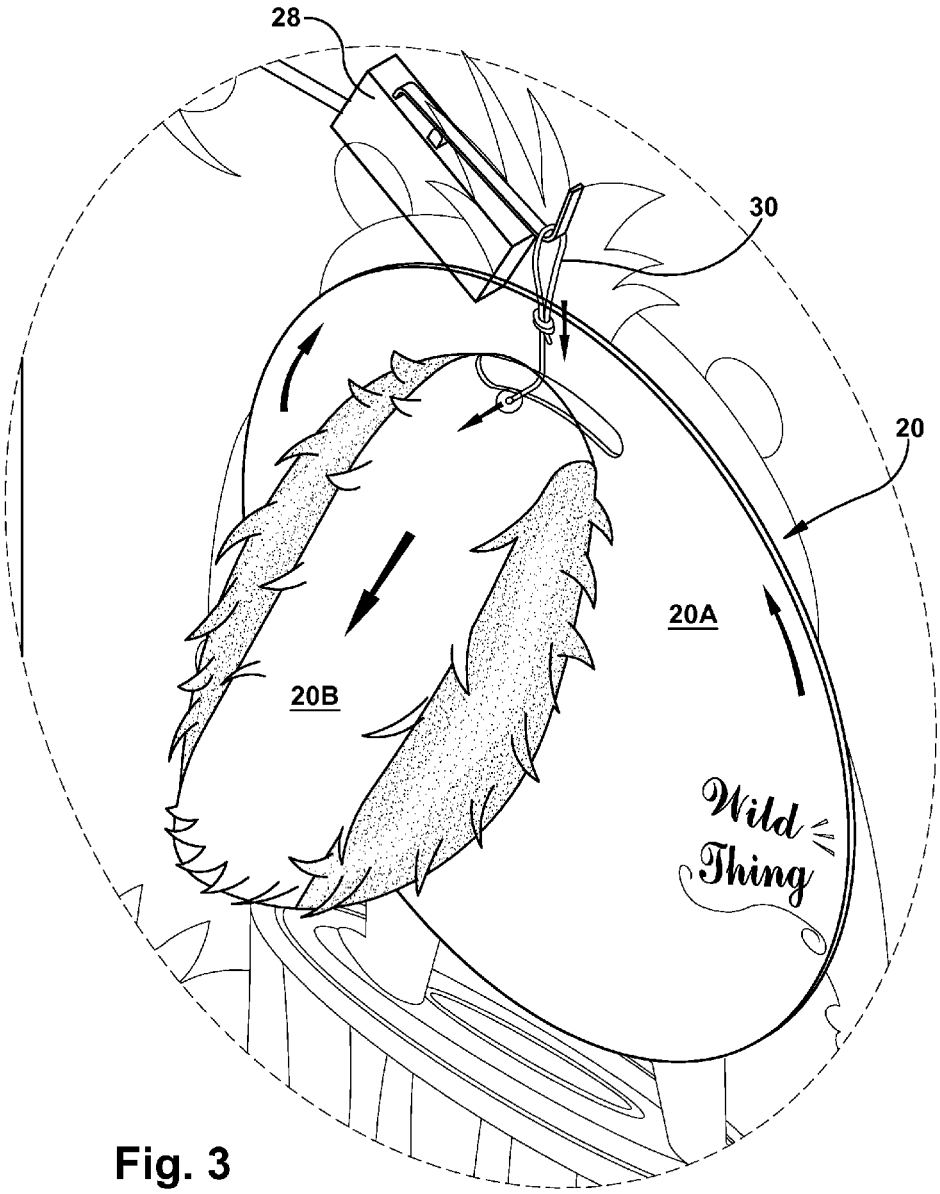
FIG. 3 is a close up perspective view of the area circled in dashed lines on FIG. 1.
Figure 4:
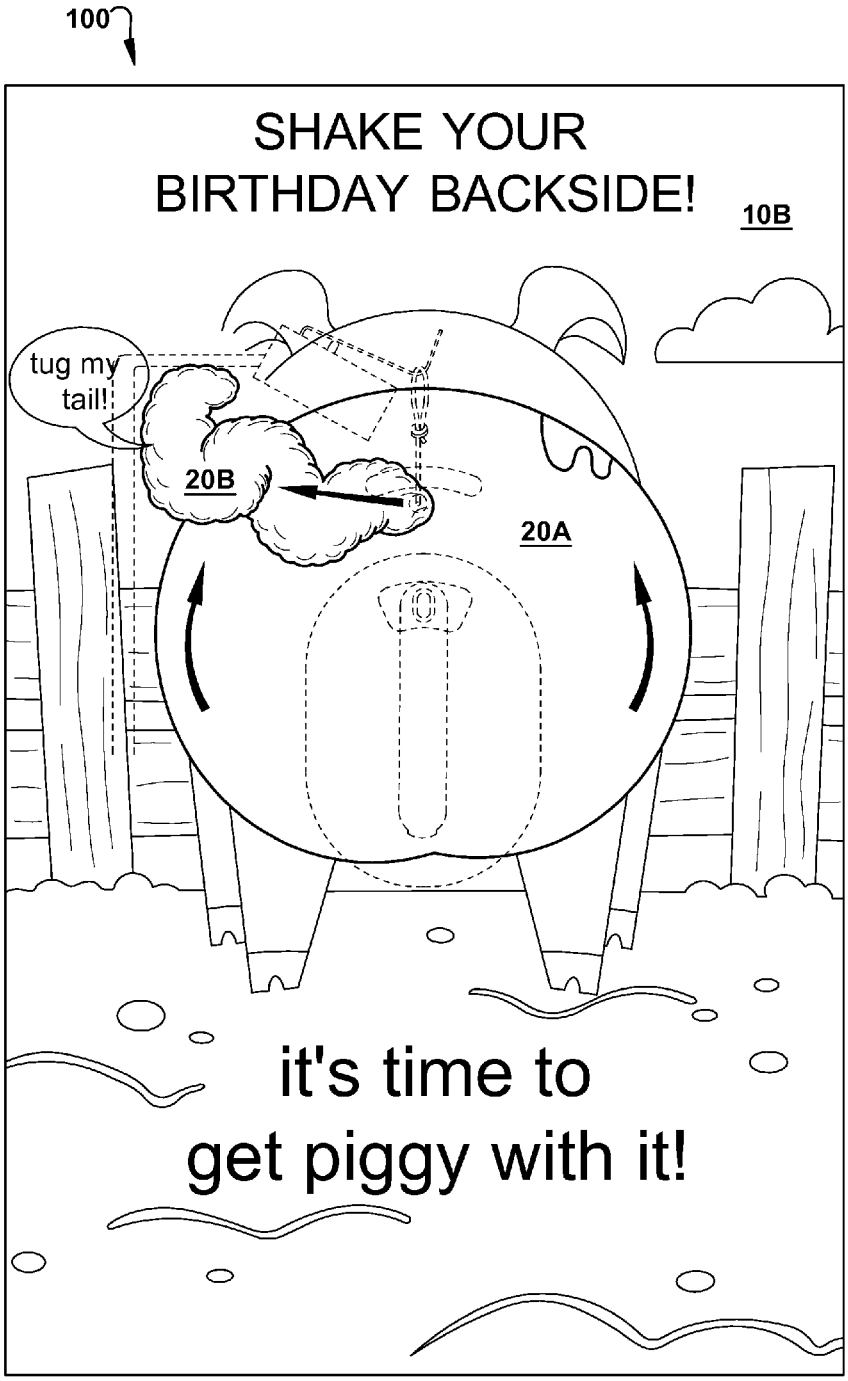
FIG. 4 is front view of an alternate embodiment of the greeting card of the present invention.

In operation, the greeting card 100 has a front cover 10B which contains printing thereon depicting a scene with an animal standing in the center with his rear end facing front. A mobile object 20, in the form of backer panel 20A and pull mechanism 20B is attached to the motor 12 via a connecting rod 18. The backer panel 20A, in a preferred embodiment, is a round, oval, heart-shaped or other similarly shaped die cut piece intending to represent the backside of the animal. Attached to the backer panel 20A is a pull mechanism 20B which is intended to represent the animal's tail. This pull mechanism 20B may be made of a variety of materials depending on the type of animal it is intended to belong to. For example, if the animal is a skunk, the tail may be made of black and/or white acrylic faux fur, as shown in FIGS. 1-3. In another example, shown in FIG. 4, if the animal is a pig, the tail may be made of a pink woolen fabric with elastic. Other examples include but are not limited to: a horse or a unicorn tail made of a plurality of rainbow-colored, high temperature resistant fiber strands; and a donkey tail made of a polyester tassel. Materials which can be used interchangeably with any of the artwork contained on the greeting cards include, but are not limited to: Tassels; faux fur; feathers; plastic; silicone; paper; cording; thread; felt; pop-poms; foam; ribbon; pipe cleaners and twine. The material selected as the pull mechanism or tail 20B is intended to provide a tactile experience for the greeting card recipient. The material used is typically a knit, woven, synthetic or other like material which is different from the material of the greeting card and is atypical of the material which is traditionally used in the production of a greeting card. The material is intended to give the effect of pulling an animal's tail and therefore provides an added tactile experience for the greeting card recipient and to increase the entertainment value provided by the greeting card. The inside of the greeting card 100 may contain further printing thereon including text sentiment and/or further artwork designs consistent with the theme of the greeting card 100. When a user receives the greeting card 100, it may have a sticker or direct printing thereon which directs the user to "pull my tail" with an arrow pointing to the pull mechanism 10B which represents the tail. When the user pulls the tail 10B, the sound and motor modules are activated causing movement of the mobile object 20 and playback of at least one pre-recorded audio clip. The sound and movement give the impression that the animal is dancing or at least moving his rear end/tail to the music. The audio clip may contain audio which is related to or complements the artwork on the greeting card. For example, if the animal represented by the artwork and tail is a cow, then the audio may include a "moo" sound or it may contain a song or saying related to a cow or it may contain a voice which is intended to sound like a cow. The motion and audio may continue for a pre-determined amount of time. The user can then open the greeting card 100 to reveal the text and artwork thereon as is typical of a traditional greeting card 100. The inside of the greeting card may also reveal the front end or face of the character or animal depicted on the front cover 10B of the greeting card 100.

Figure 6:
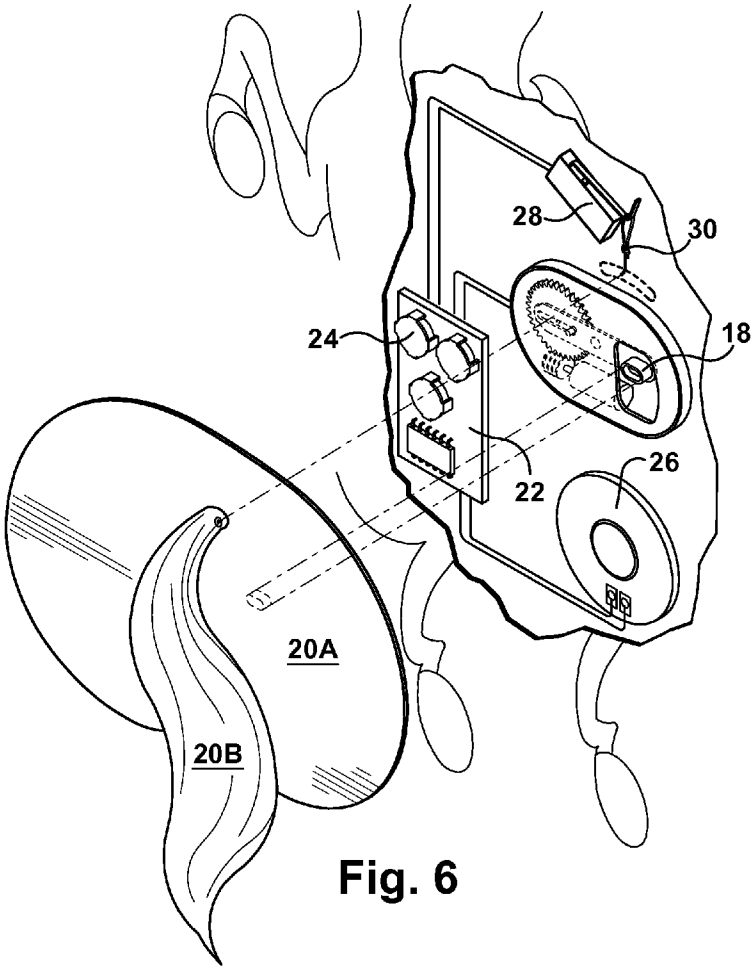
FIG. 6 is a close-up, tear-away view of the internal components of the gift bag of FIG. 5.
Figure 5:
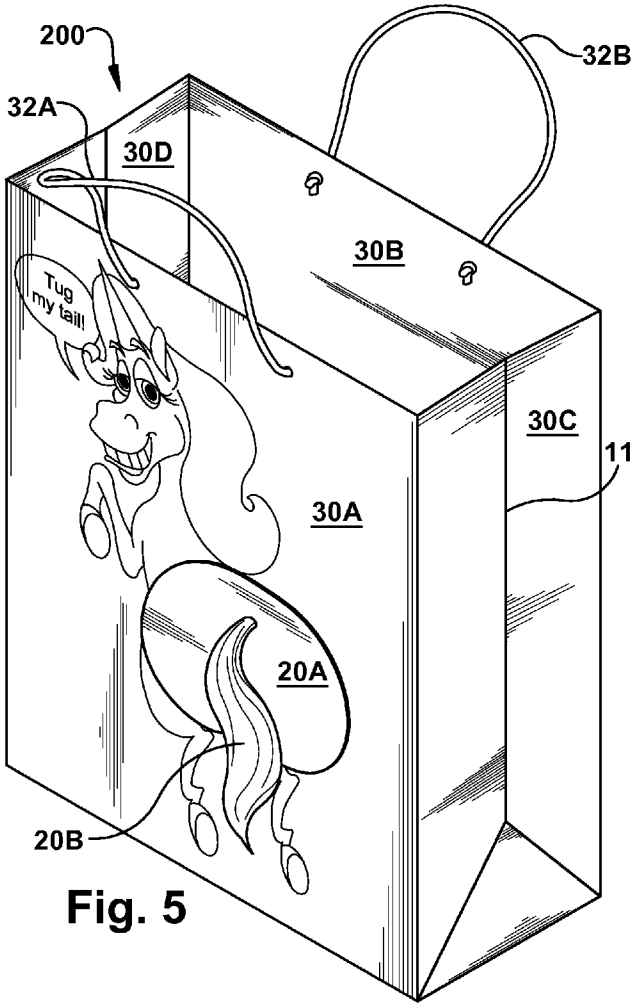
FIG. 5 is a perspective view of an alternate embodiment of present invention.

In an alternate embodiment, the interactive pull trigger mechanism intended to resemble the tail of various animals is implemented as part of a gift bag 200. This embodiment is shown in FIGS. 5 and 6. Similar to the greeting card embodiment, at least one panel of the gift bag 200 contains printing thereon depicting a scene with an animal standing in the center with is rear end facing front, as shown in FIG. 5. The gift bag 200 may be of conventional design having a front panel 30A and a back panel 30B opposite the front panel 30A with two side panels 30C, 30D extending therebetween. The width of the side panels 30C, 30D controls the width of the gift bag 200. A bottom panel connects each of the front 30A, back 30B and side panels 30C, 30D to create one closed end of the gift bag. Opposite the closed end is an open end for insertion of a gift or other item into the gift bag 200. The side panels 30C, 30D may contain a vertical bisecting fold line 11 or crease which enables the bag 200 to be neatly folded and packaged for display and/or retail sale. The gift bag 200 may also contain two handles 32A, 32B, one handle 32A attached to the front panel 30A and one handle 30B attached to the back panel 30B of the gift bag 200. The handles 32A, 32B may be similar to a rope or cord-like structure which extend between two holes or openings positioned proximate to the upper edges of the front 30A and back 30B gift bag panels along the open end of the gift bag. For example, for each handle 32A, 32B a single piece of cord or rope-like structure may be used. The two free ends of the first cord are inserted into the two holes on the front panel 30A of the gift bag and the two free ends of the second cord are inserted into the two holes on the back panel 30B of the gift bag. The cords may be inserted into each hole from the outside of the bag to the inside of the bag where each free end of the cord is tied or knotted for secure attachment to the gift bag or alternatively, the cords may be inserted from the inside of the bag to the outside of the bag, where each free end is then tied or knotted. In other embodiments, the handles may be die cut from the front and back gift bag panels. Handles may be attached from gusset to gusset or may be glued or otherwise attached to an inner surface of the gift bag. In yet other embodiments, the gift bag 200 may contain other types of handles, such as paperboard handles, plastic handles, or any other suitable handle which may or may not be removable from the gift bag. Interchangeable handles may also be used in combination with the gift bag of the present invention. Each gift bag 200 may contain drawings, images, photos or other printed indicia on the front panel 30A, back panel 30B, right 30C and left side 30D panels, and bottom panel of the gift bag. As discussed above with respect to the greeting card embodiment of the present invention, a sound and motor module are included and may be inserted between two panels of a double walled gift bag panel. The entire gift bag 200 may be double-walled or only the front panel 30A may be double walled, or both front 30A and back 30B panels. A double-walled panel creates a cavity between the two walls wherein the electronic components of the gift bag may be inserted. In a preferred embodiment, the mobile object 20 is attached to the front panel 30A of the gift bag 200. In this case, at least the front panel 30A of the gift bag 200 is double-walled so that the electronics can be contained therein and attached directly to the mobile object 20 through an opening in the front panel 30A of the gift bag 200. Alternatively, all of the walls of the gift bag 200 may be double-walled to increase the overall strength of the gift bag 200. The electronic components of the gift bag 200 are the same as those described above with respect to the greeting card embodiment. Also as described above, a mobile object 20, in the form of a backer panel 20A and a pull mechanism 20B is attached to the motor 12 via a connecting rod 18. The backer panel 20A, as described above with respect to the greeting card embodiment, is a round, oval heart shaped or other similarly shaped die cut piece intending to represent the backside of an animal. Attached to the baker panel 20A is a pull mechanism 20B which is intended to represent the animal's tail. The pull mechanism 20B may be made out of a variety of materials, as described above. For example, the gift bag 200 may contain artwork thereon depicting a flamingo and the pull-mechanism 20B is a plurality of feathers which are intended to represent the flamingo's tail. Other non-limiting examples include a pug with a curly fabric tail, a unicorn with rainbow-colored faux hair strands or any of the other examples given above with respect to the greeting card embodiment. As the case with the greeting card, in operation, a user pulls on the pull mechanism 20B which triggers audio playback and movement of the mobile object 20 (backer panel 20A and pull mechanism 20B).

While the greeting card has been described herein as having three greeting card panels connected along two fold lines, any number of greeting card panels may be used and the panels may be attached to one another in a variety of ways. The gift bag has been described herein as being of the conventional type with four panels and one open end and one closed end. However, the gift bag can be of different shapes containing a different number of gift bag panels and may contain two close ends or may be of any other non-traditional gift bag type or shape. The types of animals depicted on the greeting card and gift bag, as described herein, are not intended to limit the scope of the invention. Any type of animal may be used with any type of material representing the pull mechanism or tail. The examples set forth herein are intended as examples only and do not limit the invention in any way. Additionally, while a pull switch (the tail) is described herein, other switch types may be used or a variety of switches may be used. While the motor and sound are described as being triggered simultaneously, they can, in certain embodiments, be triggered independently by separate switches of the same or different type. The mobile object and pull mechanism are disclosed as being located on the front cover of the greeting card (or front panel of the gift bag) but may be located on the inside of the greeting card or on a back panel of the gift bag or on both the front and back panels of the gift bag. In addition to the sound and audio, other special effects may be included in the greeting card and gift bag of the present invention, such as for example, lights, including LED lights and/or fiber optics.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:

a multi-panel greeting card;

a sound module operative to store and playback at least one audio clip;

a motor module operative to cause movement to at least one mobile object, the at least one mobile object having a pull mechanism attached thereto;

wherein the pull mechanism is made of a plurality of synthetic fibers and, wherein when the pull mechanism is pulled, the sound and motor modules are activated causing replay of the at least one audio clip and movement of both the mobile object and the pull mechanism.

2. The greeting card of claim 1, wherein the pull mechanism is a faux skunk's tail.

3. The greeting card of claim 1, wherein the pull mechanism is a faux pig's tail.

4. The greeting card of claim 1, wherein the pull mechanism is a faux horse's tail.

5. The greeting card of claim 1, wherein the pull mechanism is a faux unicorn tail.

6. The greeting card of claim 1, wherein the pull mechanism is selected from one of the following: tassels; faux fur; feathers; plastic; silicone; paper; cording; thread;

felt; pop-poms; foam; ribbon; pipe cleaners and twine.

7. A greeting card comprising:

a multi-panel greeting card;

a sound module operative to store and replay at least one audio file;

a motor module operative to cause movement of a mobile object, the mobile object comprising a backer panel and a three-dimensional pull mechanism;

the backer panel attached to the motor and the three-dimensional pull mechanism attached to a switch which controls initiation of the sound and motor modules;

wherein the three-dimensional pull mechanism is made of a fabric or woven material.

8. The greeting card of claim 7, wherein the mobile object and the artwork printed on the greeting card proximate to the pull mechanism are designed to resemble the backside of an animal.

9. The greeting card of claim 8, wherein the at least one audio file contains audio related to the animal.

10. The greeting card of claim 7, wherein the at least one audio file contains the sound of an animal.

11. The greeting card of claim 7, wherein the mobile object is contained on an outside front cover of the greeting card.

12. The greeting card of claim 7, wherein the mobile object is operative to cause activation of the sound and motor modules.

13. The greeting card of claim 7, wherein the pull mechanism contains elastic.

14. The greeting card of claim 7, wherein the pull mechanism is attached to a string which is attached to the switch.

15. The greeting card of claim 7, wherein the pull mechanism is attached to a string via an opening in the backer panel and an opening in one or more greeting card panels.

* * * * *